US006845745B2

(12) United States Patent
Carey et al.

(10) Patent No.: US 6,845,745 B2
(45) Date of Patent: Jan. 25, 2005

(54) MODIFICATION OF LUBRICANT PROPERTIES IN A RECIRCULATING LUBRICANT SYSTEM

(75) Inventors: Vincent M. Carey, Sewell, NJ (US); Kevin John Kelly, Mullica Hill, NJ (US); Keith P. Saddler, Fairfax, VA (US); Kevin L. Crouthamel, Rushland, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/350,562

(22) Filed: Jan. 24, 2003

(65) Prior Publication Data

US 2003/0183188 A1 Oct. 2, 2003

Related U.S. Application Data

(60) Provisional application No. 60/360,087, filed on Feb. 26, 2002.

(51) Int. Cl.[7] ..... F02M 11/10
(52) U.S. Cl. ..... 123/196 R; 123/196 S
(58) Field of Search ..... 123/196 R, 196 S

(56) References Cited

U.S. PATENT DOCUMENTS

| | | | | |
|---|---|---|---|---|
| 3,765,392 A | | 10/1973 | Froede et al. | 123/196 |
| 4,100,082 A | * | 7/1978 | Clason et al. | 508/412 |
| 4,421,078 A | * | 12/1983 | Hurner | 123/196 R |
| 4,506,337 A | * | 3/1985 | Yasuhara | 701/30 |
| 5,067,455 A | * | 11/1991 | Okajima et al. | 123/196 R |
| 6,019,196 A | * | 2/2000 | Selby et al. | 184/1.5 |
| 6,079,380 A | * | 6/2000 | Jorgensen et al. | 123/73 AD |
| 6,408,812 B1 | * | 6/2002 | Chamberlin et al. | 123/196 R |
| 6,412,468 B1 | * | 7/2002 | Pudelski et al. | 123/196 R |
| 6,588,393 B2 | * | 7/2003 | Chamberlin et al. | 123/196 R |

FOREIGN PATENT DOCUMENTS

| | | |
|---|---|---|
| EP | 0323934 A1 | 7/1989 |
| JP | 60145412 | 7/1985 |
| JP | 11153015 | 6/1999 |
| WO | WO99/24699 | 5/1999 |

* cited by examiner

*Primary Examiner*—Henry C. Yuen
*Assistant Examiner*—Jason Benton
(74) *Attorney, Agent, or Firm*—Norby L. Foss; Joseph J. Dvorak

(57) ABSTRACT

A device and a method for real time optimizing engine lubricating oil properties in response to actual engine operating conditions. the present invention is a method that comprises measuring, directly or indirectly, a system parameter of interest near a location of interest, calculating from said parameter(s) or input(s) the amount of a secondary fluid selected from performance enhancer(s), additional base lubricant, alternatively formulated lubricant or diluent that need be added to the base lubricant; and supplementing said base lubricant with said secondary fluid before introducing the combination into said monitored location.

16 Claims, 1 Drawing Sheet

MODIFICATION OF LUBRICANT PROPERTIES IN A RECIRCULATING LUBRICANT SYSTEM

This application claims the benefit of U.S. Provisional Application No. 60/360,087 filed on Feb. 26, 2002.

FIELD OF THE INVENTION

The present invention relates to an apparatus and a process for on-line modification of a system's lubricant's properties in response to actual system condition parameters in systems employing a recirculating lubrication system. More specifically, in an engine that recirculates its lubricant, the present invention relates to an apparatus and method that alters an engine's lubricant's properties in response to actual engine conditions.

BACKGROUND OF THE INVENTION

In internal combustion engines, lubricant oils have been used to lubricate piston rings, cylinder liners, bearings for crank shafts and connecting rods, valve train mechanisms including cams and valve lifters, among other moving members. The lubricant prevents component wear, removes heat, neutralizes and disperses combustion products, prevents rust and corrosion, prevents blow by and prevents sludge formation or other deposits.

As engines produce higher power and are operated under more severe conditions, the lubricating oil's required performance and functionality have dramatically increased. These increased performance demands have resulted in a corresponding increase in the lubricant's expense. Lubricants are being made with increasingly sophisticated and expensive base stocks, including wholly synthetic base stocks. In addition, a wide variety of expensive additives, such as dispersants, detergents, antiwear agents, friction reducing agents, viscosity improvers, extreme pressure modifiers, viscosity thickeners, metal passivators, acid sequestering agents and antioxidants are incorporated into the lubricants to meet functional demands.

Lubricants have been designed to manage several engine condition parameters, such as component wear and corrosion. Lubricating oils have been formulated to ensure the smooth operation of engines under every condition by preventing the wear and seizure of engine parts. Antiwear additives are often combined with carefully selected base stocks to achieve these results. Energy loss at the frictional points of internal combustion engines is also great. For this reason, lubricating oils often include friction modifiers. Similarly, other important engine condition parameters managed by the lubricant include system cooling, deposit formation, corrosion, blow by, foaming, neutralization of combustion by-products, metal passivation and maintaining lubricant film thickness. This list is not meant to be exhaustive and one of ordinary skill in the art recognizes many other important engine parameters managed by the lubricant.

For recirculating lubricant systems, the previous art had taught that when additive concentration levels in sump oil fell below a pre-set trigger, the engine was stopped and the entire lubricating oil was replaced. An improvement on this method allowed for large quantities of the sump oil to be removed and replaced with fresh lubricant during operation. Later practitioners modified this method to extend a recirculating lubricant's useful life by injecting additive into the sump when monitored sump additive concentrations were depleted below a preset level.

The early methods of total or near total lubricant replacement were wasteful because they jettisoned many expensive components if only one additive concentration was lacking. These methods were further deficient in that the concentration of an additive did not necessarily correlate to the actual effectiveness (or ineffectiveness) of the lubricant inside the engine at any given point. Even if it did, substantial research has demonstrated that the concentration of the additive in the sump was not an accurate reflection of the additive concentration at the lubrication point of interest. See Malcolm Fox, et al., "Composition of Lubricating Oil in the Upper Ring Zone of an Internal Combustion Engine", *Tribology International*, Vol. 24 No. 4, pp. 231–33 (August 1991). Therefore, these methods were not widely adopted as they did not ensure that the system's actual lubrication needs would be fulfilled.

SUMMARY OF THE INVENTION

The present invention relates to a system and a process for real time varying of a system's lubricating oil's properties or flow rate in response to actual system lubrication requirements in systems that recirculate their lubricant. The invention is not limited to internal combustion engines, but applies equally well for gas turbine engines as well as other machinery and equipment that recirculate their lubricant.

Preferably, the present invention provides a system and a method for the in situ monitoring of a lubricating oil's effectiveness and for modifying its properties and/or flow rate in response to the actual wear or corrosion needs of the machinery or engine. More preferably, the present invention provides a system and method for determining the base lubricant's effectiveness in a four-stroke internal combustion engine and providing a means to adjust the lubricant's effectiveness by the controlled addition of at least one secondary fluid selected from performance enhancers, additional base lubricants, alternatively formulated lubricants or diluents.

DETAILED DESCRIPTION

Figure 1:
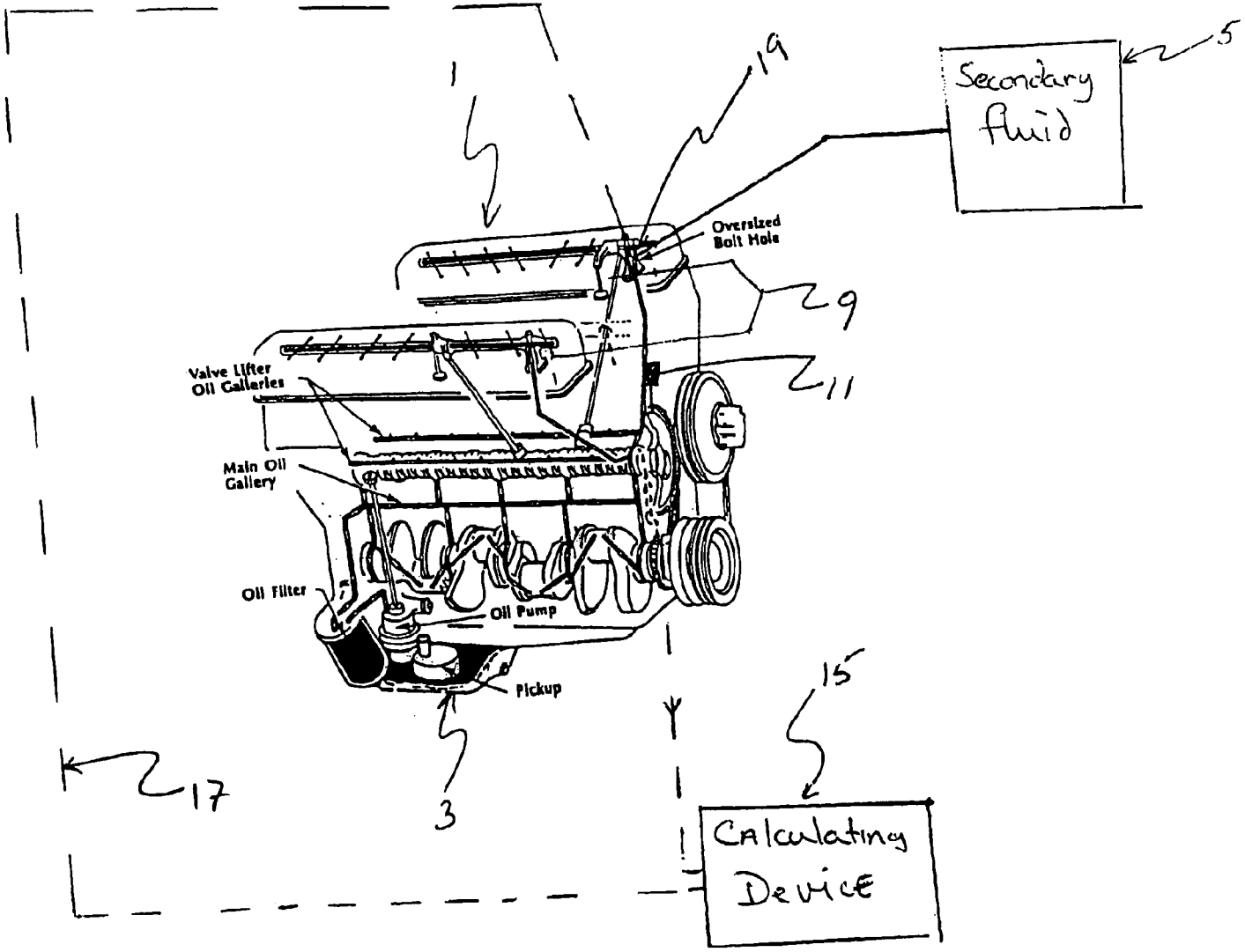
FIG. 1 schematically illustrates a cross-section of this device applied to a four-stroke internal combustion engine.

The increased performance demands of modern engines have resulted in their mounting sophistication, complexity and sensitivity. In response, engine lubricants have also become more advanced by utilizing more complex base stocks and additives. However, such innovations also provoke higher costs in both the base stocks and the additives.

The system condition parameter of interest, such as wear or corrosion, may be measured directly or indirectly by predicting it from other system, machinery or fuel parameters. As a non-limiting example, the wear of a component of interest could be directly measured by determining the metal or metal oxide particles present in the drip-down lubricant from that point before the lubricant re-mixes into the sump. In the alternative, wear may also be predicted from other parameters. For example, research has shown that piston ring wear in four-cycle diesel engine may be predicted from the sulfur content of the fuel, and the total base number ("TBN") of the lubricant. See J. A. McGeehan, "Effect of Piston Deposits, Fuel Sulfur, and Lubricant Viscosity on Diesel Engine Oil Consumption and Cylinder Bore Polishing", SAE 831721, 1983. Thus, piston ring wear may be measured directly or indirectly by accurately predicting it from other parameters.

In one embodiment, the present invention is a method that comprises:

In a system that recirculates its lubricant, measuring, directly or indirectly, at least one system condition parameter of interest.

Calculating from said system condition parameter the amount of a secondary fluid to be added to the base lubricant to manage said system condition parameter, said secondary fluid being selected from a group consisting of performance enhancer(s), additional base lubricant, alternatively formulated lubricant or diluent or a combination thereof.

Mixing said base lubricant with said secondary fluid before the introduction of the combination into said monitored part or location.

In another embodiment, the present invention is a system comprising of an engine that recirculates its base lubricant, a secondary fluid being selected from a group comprising performance enhancer(s), additional base lubricant, alternatively formulated lubricant or diluent, a measuring device that determines, directly or indirectly, the value of the system condition parameter of interest at a location of interest, a calculation device employing an algorithm that determines the necessary modifications to the base lubricant by the addition of said secondary fluid, and a blending means that mixes the components before they arrive at the system location of interest.

The blending means may be as simple as injecting the secondary fluid into the base lubricant allowing the flow currents to mix them. Other mixing or stirring devices, such as paddle, venturi or screw devices, could be employed. This list is not meant to be a complete list of blending means and one of ordinary skill in the art may easily determine other means of blending the secondary fluid into the base lubricant. While preferable, it is not a requirement of the present invention that the secondary fluid be extensively or completely blended into the base lubricant. The only requirement is that the introduction of the secondary fluid affects the system condition parameter of interest.

This invention may be applied to many engine, machinery and equipment types that recirculate their lubricant. As a non-limiting example, the present invention could be applied to a common four-stroke internal combustion engine. Although cylinder lubrication occurs from oil splashing from the crankcase, an area of great concern is valve train wear which has its own lubricant circuit. Applying the current invention, a metal particle monitor is located in the valve train oil return channel to monitor the supplied lubricant before it returns to the sump. Other measurements may also be used to indirectly determine the system component parameter wear such as by measuring fuel sulfur levels, $SO_x$ or $NO_x$ emissions, the lubricant oil's metal content, lubricant oil's metal oxide content, lubricant oil's acidity, lubricant oil's capacitance, lubricant oil's film thickness, lubricant oil's viscosity, the fuel sulfur content, cylinder temperature, coolant temperature, lubricant temperature, engine r.p.m and engine load, etc. This is not meant to be an exhaustive list of measurements that would indirectly determine a system condition parameter and one of ordinary skill in the art would easily be able to determine others such measurements.

In response to the actual or calculated wear parameters, the base lubricant is modified with a secondary fluid chosen from performance enhancers, additional base lubricant, alternatively formulated lubricants or diluents. These base lubricant modifications manage the amount of metal particles detected in the return channel, in this case minimizing it in real or near real time. Similarly, this technique could be applied to manage other system condition parameters such as metal corrosion, system cooling, metal passivation, blow by, foaming and deposit formation. This is not meant to be a complete list of system condition parameters and one of ordinary skill in the art could easily determine other system condition parameters that could be managed by the present invention.

In another non-limiting example, the present invention may be used in gas turbine or jet engines. Lubricant in a gas turbine engine not only combats friction wear, but also is used as a cooling agent, sealing agent and has a cleaning effect on the bearings throughout the gas turbine engine. While wear is a factor in the high temperature, high stress environment of gas turbine engines, the viscosity, anti-friction and chemical stability of the lubricant are also of great importance.

The three greatest factors limiting the useful life of a gas turbine oil are change in viscosity, foaming and fluid cleanliness. The viscosity of a gas turbine engine oil must be precisely balanced. It must be high enough for good load carrying ability, but low enough for good flow ability. Similarly, the lubricant must not foam nor evaporate under low-pressure high-temperature conditions. Finally, since the lubricant is mostly used on fast moving, highly machined bearings, cleanliness, and lack of carbon deposit build up is crucial.

As opposed to measuring the level of specific additives in the gas turbine lubricant, the viscosity and the amount of foaming in the lubricant may be directly measured. This provides an actual snapshot of the effectiveness of the lubricant in the gas turbine engine, as opposed to simply assuming that the additive levels are actually protecting the lubricated parts. Viscosity may be directly measured in-line by well known technologies of electro-magnetically driven pistons or acoustic waves. Based upon the results of these measurements, the base lubricant is modified with a secondary fluid being selected from a group comprising performance enhancer(s), additional base lubricant, alternatively formulated lubricant or diluent.

The present invention only monitors the system condition parameter at a location of interest. When used with respect to the present invention, the phrase "at location of interest" means determining the system condition parameter at a location other that at the bulk oil charge in the sump. For example, if the area of concern were the wear of the entire valve train, then the measurement of the metal or metal oxides in the lubricant would be determined at a location in the drip-down stream before the lubricant re-entered the sump.

Because the present invention only need measure a single system condition parameter at a location of interest, measurements required by previous devices are not necessary. For example, previous systems required information comparing the additive concentration of the used lubricant to that of the initial lubricant. However, the present invention does not need this information. The present invention modifies the base lubricant solely in response to the system condition parameter monitored at a location of interest. It is therefore unnecessary to know the initial parameters of the lubricant. In the present invention, only one measurement is necessary to determine whether the addition of secondary fluid to the base lubricant going to the location of interest is managing the system condition parameter as desired. The present invention succeeds because it controls the actual system parameter, not unrelated chemical concentrations.

FIG. 1 details another non-limiting example of the present invention, adapted for use to prevent wear in the piston rings and cylinder of an internal combustion engine. In this example, the present invention comprises a four-stroke internal combustion engine (1) with base lubricant in a sump (3). There is at least one source (5) of secondary fluids usually selected from a group including performance enhancers, additional base lubricant, alternatively formulated lubricant or diluent of known or determined (7) properties.

The wear of the valve train components (9), a system condition parameter, may be either directly or predictively measured. For direct measurement, as a non-limiting example, the metal or metal oxide content in the lubricant dripping down (11) from the valve train is determined. These inputs (13) are sent to a calculating device (15) employing an algorithm (either digitally or manually computed) which determines the amount of secondary fluid that need be introduced into the lubricant to limit wear. While it is preferred that this be done automatically, manual calculation may suffice when the engine operating conditions and inputs vary slowly or infrequently. A signal (17) is sent to the blender (19) which combines the secondary fluid into the base lubricant before being reintroduced to the valve train. It is expected that sufficient protection would be provided to all cylinders by monitoring only one cylinder, however, the present invention allows for the monitoring and blending for each individual cylinder.

In most operating conditions, varying the lubricant properties by the addition of a secondary fluid is sufficient and the most effective manner in which to ensure proper lubrication. However, under certain conditions, the flow rate of the lubricant may also need be adjusted by the algorithm for the most efficient use of lubricants and secondary fluids and to ensure proper lubrication. The inventors would expect that the real world implementation of the present invention would allow the algorithm to control both the addition of secondary fluid and the varying of base lubricant flow rate.

The present invention provides at least three distinct advantages over previous teachings. First, the present invention does not need to monitor, nor determine the properties of the lubricant entering the system. This information is not necessary as the present invention monitors and reacts to a specific system condition managed by a lubricant function at a specific location or part within the engine. The prior art monitored and replenished used oil additive concentration going into the engine. These concentrations do not correlate to the system condition parameter of interest nor the lubricant performance at that location. The present invention modifies lubricant properties in a direct response to a measured system stress and/or the lubricant's effectiveness at a location of interest, rather than making a comparative assessment of the used oil's additive concentration in the sump.

Second, the present invention detects system degradation in real or near real time because it monitors actual system condition parameters at the point of interest as opposed to the previous teaching of monitoring additive levels after they have been diluted by mixing into the sump or reservoir. As in the example previously noted, the engine wear was measured directly in the drip down oil from the valve train. Previous practitioners always monitored lubricant additive concentration at the sump. Even if there was a correlation between lubricant additive concentration and the lubricant's true effectiveness, this correlation would be masked as it was not determined until well after the drainback lubricant was diluted into the system's entire lubricant. Further, the prior art did not determine a system condition parameter at a specific location of interest, but only provided a general overall estimate of at system health at the lubricant reservoir. The present invention allows for far more accurate monitoring and management of the actual system health by varying lubricant parameters in response to actual system stresses.

Finally, the present invention is far more economical because it only supplements the base lubricant with the specific secondary fluid as necessary in response to the actual system lubrication requirements as opposed to the complete or significant replacement of the entire lubricant in response to a preset trigger. Not only does the present invention actually protect the engine from wear, deposits or other degradations of concern, but it does so in the most economic way instantly tailoring the properties of the lubricant to overcome the stress encountered by the engine.

What is claimed is:

1. A process for the modification of a lubricant's properties in a system that recirculates the lubricant from a sump during system operations, the process comprising:

(a) repeatedly measuring, directly or indirectly, one or more system condition parameters at a location of interest in the system other than in the sump;

(b) calculating from said system condition parameters an amount of secondary fluid to add to said base lubricant, said secondary fluid being one or more fluids selected from the group consisting of performance enhancers, base stocks, additional formulated lubricants, diluents or a mixture thereof, (c) mixing said base lubricant with said secondary fluid creating a modified base lubricant, (d) applying said modified base lubricant to said location of interest.

2. A process as in claim 1 wherein the system is an engine.

3. A process as in claim 2 wherein the system condition parameter is one or more selected from a group consisting of metal wear, system cooling, deposit formation, corrosion, blow by, foaming, neutralization of combustion by-products, metal passivation and lubricant film thickness.

4. A process as in claim 3 wherein said engine is an internal combustion engine.

5. A process as in claim 3 wherein said engine is a gas turbine engine.

6. A process as in claim 4 where said internal combustion engine is a four-stroke engine.

7. A process as in claim 6 wherein said location of interest is the valve train.

8. A process for the modification of a lubricant's properties during use in an engine that recirculates the lubricant from a sump during engine use, the process comprising:

(a) repeatedly measuring, directly or indirectly, at a location of interest other than in the sump, one or more engine condition parameters of interest selected from a group consisting of metal wear, engine cooling, deposit formation, corrosion, blow by, foaming, neutralization of combustion by-products, metal passivation and lubricant film thickness;

(b) calculating from said one or more engine condition parameters an amount of secondary fluid to be added to said base lubricant, said secondary fluid being one or more fluids selected from the group consisting of performance enhancers, additional base lubricant, alternatively formulated lubricants, diluents or a mixture thereof, wherein said performance enhancers being one or more items selected from a group consisting of detergents, dispersants, antioxidants, antiwear agents, friction-reducing agents and viscosity improvers, viscosity thickeners, extreme pressure additive, metal passivators, acid sequestering agents or a mixture thereof;

(c) mixing said base lubricant with said calculated amount of said secondary fluid creating a modified base lubricant;

(d) introducing said modified base lubricant to said location of interest.

9. An apparatus for the modification of a lubricant's properties in a system comprising:

(a) a system that recirculates one or more base lubricants contained in a sump, (b) at least one secondary fluid selected from a group consisting of performance enhancers, additional base lubricant, alternatively formulated lubricants, diluents or a mixture thereof, (c) a measuring device to determine, directly or indirectly, the value of at least one system condition parameter at a location of interest other than in the sump;

(d) a calculating device employing an algorithm operating on one or more of said system condition parameters that determines the amount of said secondary fluid to add to said base lubricant, and (e) a blending means to mix said base lubricant and said secondary fluid prior to the mixtures re-introduction to said system part or system area of interest.

10. An apparatus as in claim 9 wherein said system is an engine.

11. An apparatus as in claim 10 wherein said engine is an internal combustion engine.

12. An apparatus as in claim 10 wherein said engine is a gas turbine engine.

13. An apparatus as in claim 11 wherein said internal combustion engine is a four-stroke engine.

14. An apparatus as in claim 13 wherein said system condition parameter is one or more parameters selected from the group comprising metal wear, engine cooling, deposit formation, corrosion, blow by, foaming, neutralization of combustion by-products, metal passivation and lubricant film thickness.

15. An apparatus as in claim 14 wherein said secondary fluid being one or more fluids selected from the group comprising of performance enhancers, additional base lubricant, alternatively formulated lubricant, diluent or a mixture thereof, wherein said performance enhancers being one or more items selected from a group consisting of detergents, dispersants, antioxidants, antiwear agents, friction-reducing agents and viscosity improvers, viscosity thickeners, extreme pressure additive, metal passivators, acid sequestering agents or a mixture thereof.

16. An apparatus that modifies the lubricant properties of one or more base lubricants in an operating engine comprising:

(a) an internal combustion engine that recirculates said base lubricant contained in a sump;

(b) at least one secondary fluid selected from a group comprising of performance enhancers, base stocks or additional formulated lubricants, wherein said performance enhancers being one or more items selected from a group consisting of detergents, dispersants, antioxidants, antiwear agents, friction-reducing agents and viscosity improvers, viscosity thickeners, extreme pressure additive, metal passivators, acid sequestering agents or a mixture thereof;

(c) a measuring device to measure, directly or indirectly, one or more engine condition parameters near a location of interest other than in the sump, said parameters selected from a group consisting of metal wear, engine cooling, deposit formation, corrosion, blow by, foaming, neutralization of combustion by-products, metal passivation and lubricant film thickness;

(d) a calculating device employing an algorithm operating on one or more of said selected engine condition parameters and said base lubricant properties that determines the amount of said secondary fluid to add to said base lubricant;

(e) a blending means to mix said base lubricant with said secondary fluid prior to the resultant mixture's re-introduction to said location of interest.

* * * * *